US005669267A

United States Patent [19]

Ross et al.

[11] Patent Number: 5,669,267

[45] Date of Patent: Sep. 23, 1997

[54] REMOTE CONTROL APPARATUS AND RELATED METHOD

[75] Inventors: William J. Ross, Sarasota; Andrew K. Stiteler, Bradenton; Jerald G. Wagner, Venice, all of Fla.

[73] Assignee: IMO Industries, Inc., Sarasota, Fla.

[21] Appl. No.: 601,100

[22] Filed: Feb. 14, 1996

[51] Int. Cl.[6] ..... G05G 11/00

[52] U.S. Cl. ..... 74/480 B; 74/480 R; 74/500.5; 74/501.6; 440/84; 477/112

[58] Field of Search ..... 74/480 R, 480 B, 74/500.5, 501.6; 440/84, 86; 477/112

[56] References Cited

U.S. PATENT DOCUMENTS

| | | | |
|---|---|---|---|
| 3,958,524 | 5/1976 | Cantley et al. | 74/480 B X |
| 4,020,713 | 5/1977 | Cantley et al. | 74/480 B X |
| 5,216,934 | 6/1993 | Iwasaki | 74/480 B X |

OTHER PUBLICATIONS

Morse Controls Dual Station Unit Technical Brochure; Publisher: Morse Controls Division of IMO Industries, Hudson, Ohio—Jan., 1995—2 pages.

*Primary Examiner*—Allan D. Herrmann

*Attorney, Agent, or Firm*—Jansson & Shupe, Ltd.

[57] ABSTRACT

Disclosed is a remote-control apparatus having a base and a first slider supported with respect to the base. A first cable includes a first conduit and a first core coupled to the slider and movable in the first conduit. An output cable includes a clamped conduit supported with respect to the base and having an output core movable in the clamped conduit. In the improvement, the apparatus includes a second slider supported with respect to the base. A second cable has a second conduit and a second core coupled to the second slider and movable in the second conduit. The first core and the output core are coupled to the first slider and the second core is coupled to the second slider. A new method for remotely controlling a mechanism, e.g., a boat outboard engine throttle or clutch, is also disclosed.

16 Claims, 10 Drawing Sheets

REMOTE CONTROL APPARATUS AND RELATED METHOD

FIELD OF THE INVENTION

This invention relates to control systems and, more particularly, to remote control systems using push-pull cables to transfer a force from one location to another.

BACKGROUND OF THE INVENTION

So-called "push-pull" cables have been known and used for decades to reliably and economically provide a way to transfer force along a flexible cable from one location to another. Such cables are disclosed in U.S. Pat. Nos. 2,601,791 (Morse); 2,706,494 (Morse) and 5,245,887 (Tanaka et al.), among others. (J. F. Morse was a pioneer in the development and popularization of such cables and the Morse Controls Division of IMO Industries, Inc. is a leading manufacturer thereof.)

In the terminology used in the industry, a remote control cable of the foregoing type has a flexible, elongate tube-like portion known as a conduit. Such conduit has a central passageway and a "wire-like" flexible portion, known as the core, extends along the passageway with slight clearance.

In a typical use, the ends of the conduit are fixed at respective (and often widely-separated) locations and an input device, e.g., a foot pedal, hand lever or the like, is attached to one end of the core. The other end of the core is attached to that mechanism which is being controlled, e.g., an engine throttle, clutch, lever or the like. A force applied to the input device (usually a manually-applied force) moves the core with respect to the conduit and extends the force along the core to the controlled mechanism. As a more specific example, a bus operator may operate the throttle of the rear-mounted bus engine using a remote control cable extending between the accelerator pedal and the throttle.

And "single-input" applications are not the only type on which remote control cables are used. There are situations where a single output function, e.g., a boat engine throttle, is to be operated from either of two different locations, i.e., the boat helms. (Certain types of boats have a relatively-unsheltered flying bridge high above the water line and another bridge closer to the water line and in a cabin. The boat can be controlled from either bridge and the "points" of control are known as helms.) A known apparatus used in such an arrangement is shown in a brochure distributed by Morse Controls, Hudson, Ohio. Such brochure involves a dual station unit for single lever dual function controls.

Using the single-slider apparatus depicted in the Morse Controls brochure, an output function such as the engine throttle may be operated using either of two remote control cables. The conduit of the first cable is clamped to the slider and the core of the second is attached to the same slider. (Attachment is by threading the core into a fitting that is in a tube screwed to the slider.) The remote output function may be controlled by moving the core of the first cable having the clamped conduit (such cable thereby serving as both an input cable and an output cable) or by moving the core of the second cable, i.e., that core attached to the slider. In the latter instance, the conduit and core of the first clamped cable move in unison. That is, there is no relative movement between such conduit and core.

While the dual station unit of the Morse Controls brochure has been generally satisfactory for its intended purposes, it is not without some disadvantages. Chief of among them is the fact that it is extremely difficult to use such dual station unit except by mounting it very close to the mechanism being controlled so that the threaded rod end of the output core can be attached to such mechanism. This constraint usually means that both cables must extend from such mechanism over some distance to the control device, e.g., a helm lever, being used to manipulate the mechanism.

Another disadvantage of the known dual station unit involves a boat powered by an outboard engine. Outboard engine manufacturers make no provision, e.g., a mounting bracket, at or near the engine on which the unit can be mounted.

Yet another disadvantage of the dual station unit is that it does not lend itself well to applications other than those involving boats. There are industrial applications which can benefit from a new remote control apparatus.

One example of such an application is a mobile construction machine known as a loader-backhoe. A specific type of loader-backhoe resembles a farm tractor and has a bucket-type loader at the front and a backhoe at the rear. The operator's seat pivots 180°. Certain of the operator's controls are "dual" in that the same mechanism being controlled, e.g., the engine throttle, may be controlled from either seat position.

Still another disadvantage of the above-described dual station unit is that it is difficult to "cascade," i.e., to use by connecting it to another dual station unit. If cascaded, both units are mounted very close to the mechanism being controlled so that the threaded rod end of the output core can be attached to such mechanism. Therefore, the three or four cables used with such units must extend from such mechanism over some distance to the control device.

A new remote control apparatus which overcomes some of the problems and shortcomings of earlier products in this field would be an important advance in the art.

OBJECTS OF THE INVENTION

It is an object of the invention to provide a new remote control apparatus and method overcoming some of the problems and shortcomings of the prior art.

Another object of the invention is to provide a new remote control apparatus and method suitable for use with boat outboard engines.

Another object of the invention is to provide a new remote control apparatus which can be mounted well away from a boat engine including an outboard engine.

Another object of the invention is to provide a new remote control apparatus and method suitable for use with non-marine, e.g., industrial, and other applications.

Yet another object of the invention is to provide a new remote control apparatus which permits "closely-coupled" arrangements, i.e., arrangements where the operator's input device and the apparatus are in close proximity to one another.

Another object of the invention is to provide a new remote control apparatus and method which reduce the number of cables required to be extended over significant distances.

Still another object of the invention is to provide a new remote control apparatus and method which reduces costs including installation costs.

Another object of the invention is to provide a new remote control apparatus which may be conveniently used in series or in parallel with another apparatus.

Another object of the invention is to provide a new remote control apparatus which, in one embodiment, includes a redundant return spring. How these and other objects are accomplished will become apparent from the following descriptions and from the drawings.

SUMMARY OF THE INVENTION

The invention involves a remote-control apparatus of the type having a base and a slider supported with respect to the base. The apparatus also has a first cable including a first conduit and a first core coupled to the slider and movable in the first conduit. An output cable includes a clamped conduit supported with respect to the base and having an output core movable in the clamped conduit.

In the improvement, the slider is a first slider and the apparatus includes a second slider supported with respect to the base and a second cable. Such second cable has a second conduit and a second core coupled to the second slider and movable in the second conduit. The first core and the output core are coupled to the first slider and the second core is coupled to the second slider. And the clamped conduit and the second conduit are fixed with respect to the base as well as supported with respect to the base. In one embodiment, each of the cables has a terminus and each terminus is adjacent to the base.

In another aspect of the invention, the output core is telescoped into and coupled to the first slider by an output tube attached to the first slider. Such tube extends (with slight clearance) through an opening in the second slider. Similarly, the second core is coupled to the second slider by a second tube attached to the second slider and extending through the first slider. So configured, the first and second sliders can move independently of one another.

Using the aforedescribed arrangement, a force originating at a first control device and extending along the first core is coupled to the output core through the first slider. A force originating at a second control device and extending along the second core is coupled to the output core through the second slider and the first core.

In an exemplary application, the two control devices may be engine throttle controls at respective helms on a boat. The output core is coupled to the engine throttle so that force applied to either throttle control can change engine speed. Another exemplary application involves an industrial application, e.g., a mobile loader-backhoe, with two available operator positions, each having a foot-pedal-type engine throttle control. A mechanism being controlled by the new apparatus may involve either of two types, namely, push-to-actuate and pull-to-actuate. (An exemplary mechanism is a boat engine throttle moved between a low-speed position at one extreme of travel and a high-speed position at the other extreme. Such throttles are of the push-to-accelerate or the pull-to-accelerate type.)

In another aspect of the invention, the apparatus can be easily configured for either push-to-actuate or pull-to-actuate mechanisms. Such apparatus has an end plate and, preferably, two spaced end plates. The base includes a first group of holes for mounting an end plate to configure the apparatus to operate a mechanism, e.g., a throttle, of the pull-to-actuate type. There is also a second group of holes for alternatively mounting the end plate, thereby configuring the apparatus to operate a mechanism of the push-to-actuate type.

But mechanisms such as engine throttles are not the only application for the new apparatus. It may also be used to operate a clutch or other mechanism requiring movement to either side of a center or neutral position. To that end, the base includes a third group of holes for mounting the end plate, thereby configuring the apparatus to operate a bi-directionally-actuated mechanism such as the exemplary clutch. In a specific embodiment, the third group of holes is between the first group and the second group.

And that is not all. In another configuration, two apparatus may be used by mounting first and second apparatus in stacked relationship to one another. Plural, post-like spacers extend between the first and second apparatus to retain such apparatus in a fixed, spaced relationship with respect to one another.

Another aspect of the invention involves a method for remotely controlling a mechanism such as a throttle or clutch. The method includes the steps of providing a system having first and second sliders, and an output cable with its output core extending between the first slider and the mechanism. The provided system also has a first input cable with its core (a "first" core) extending between a first control device and the first slider, and has a second input cable with its core (a "second" core) extending between a second control device and the second slider. Such control devices are typically human-operated, manual-input devices although, clearly, machine-operated input devices may be used in appropriate applications.

The first device, e.g., a helm throttle lever, is manipulated to apply a force to the controlled mechanism through the first core, the first slider and the output core. A more specific method also includes manipulating the second device to apply a force to the mechanism through the second core, the second slider, the first core and the first slider.

Other features of the invention are set forth in the following detailed description and in the drawings.

BRIEF DESCRIPTION OF THE DRAWINGS

" FIG. 8 is a simplified top plan view of the apparatus configured for controlling a bi-directionally-actuated clutch of the type commonly used on boats. The apparatus is shown with the clutch in the neutral position.

FIG. 9 is a view like that of FIG. 8 showing the apparatus when the lever "LA" is pushed to a clutch-forward position.

FIG. 10 is a view like that of FIG. 8 showing the apparatus when the lever "LA" is pulled to a clutch-reverse position.

FIG. 11 is a view like that of FIG. 8 showing the apparatus when the lever "LB" is pushed to a clutch-forward position.

FIG. 12 is a view like that of FIG. 8 showing the apparatus when the lever "LB" is pulled to a clutch-reverse position.

FIG. 13 is a simplified top plan view of the apparatus configured for controlling a throttle of the pull-to-actuate type as commonly used on boats. The apparatus is shown with the throttle in the low speed or idle position.

FIG. 14 is a view like that of FIG. 13 showing the apparatus when the lever "LA" is pulled to open the throttle and increase speed.

FIG. 15 is a view like that of FIG. 13 showing the apparatus when the lever "LB" is pulled to open the throttle and increase speed.

FIG. 16 is a simplified top plan view of the apparatus configured for controlling a throttle of the push-to-actuate type as commonly used on boats. The apparatus is shown with the throttle in the low speed or idle position.

FIG. 17 is a view like that of FIG. 16 showing the apparatus when the lever "LA" is pushed to open the throttle and increase speed.

FIG. 18 is a view like that of FIG. 16 showing the apparatus when the lever "LB" is pushed to open the throttle and increase speed.

DETAILED DESCRIPTION OF PREFERRED EMBODIMENTS

Figure 1:
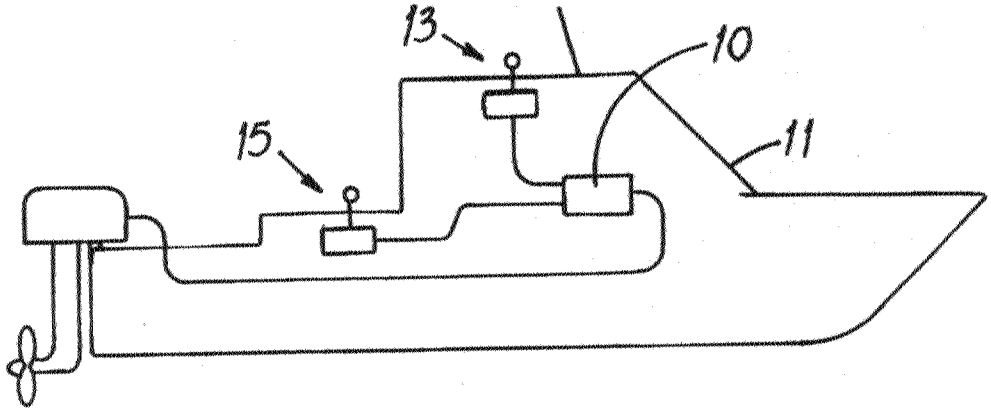
FIG. 1 is a representative view of the new apparatus shown in conjunction with a side elevation view of a boat having two helms for controlling an outboard engine using such apparatus.
Figure 2A:
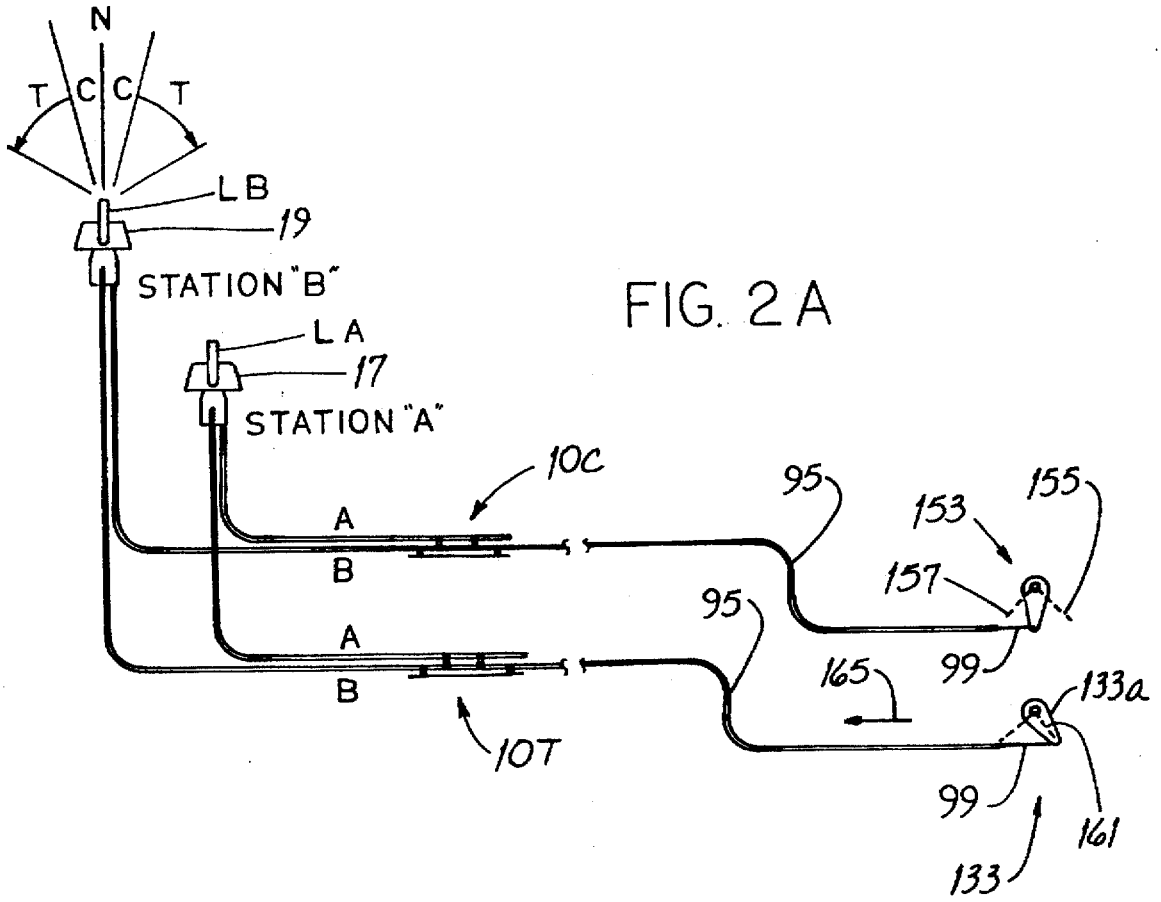
FIG. 2A is a schematic diagram showing how two helms may be used to control the clutch and pull-to-actuate throttle of the boat of FIG. 1.

Before describing the new remote-control apparatus 10 and method, it will be helpful to have an understanding of an exemplary application on which such apparatus 10 may be used. As shown in FIGS. 1 and 2A, the representative boat 11 has a flying-bridge helm 13 and a cabin helm 15. Such helms 13, 15 are identified in FIG. 2A as stations A and B, respectively.

Each of the helms 13, 15 has a control device, namely, the first device 17 at station A and the second device 19 at station B. Each device 17, 19 (which is known per se) is of the type wherein a single manually-operated lever (levers LA and LB, respectively) controls both the outboard engine clutch mechanism and the engine throttle mechanism. Each device 17, 19 is cable-coupled to an apparatus 10C for clutch control and to an apparatus 10T for throttle control.

Figure 3:
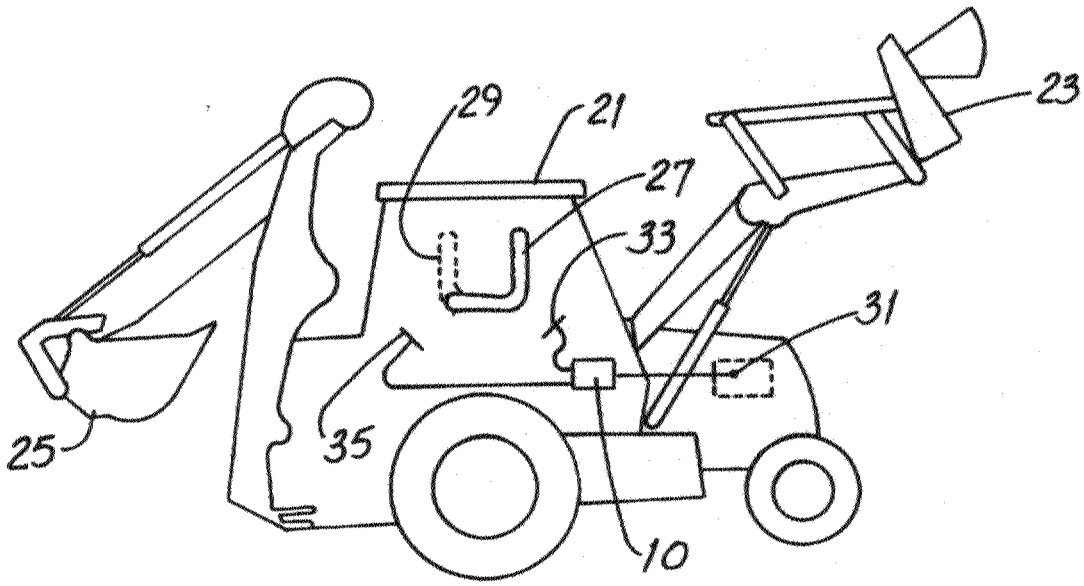
FIG. 3 is a representative side elevation view of an industrial loader-backhoe with which the new apparatus may be used.

Referring now to FIG. 3, another exemplary application on which the apparatus 10 may be used involves an industrial machine known as a loader-backhoe 21. The loader-backhoe 21 has a loader 23 at the front and a backhoe 25 at the rear and as represented by the seat back in the solid-outline position 27 and in the dashed-outline position 29, the operator's seat pivots 180°. The engine throttle 31 may be controlled through an apparatus 10 from either seat position 27, 29 using separate pedals 33, 35 or separate levers.

Figure 4:
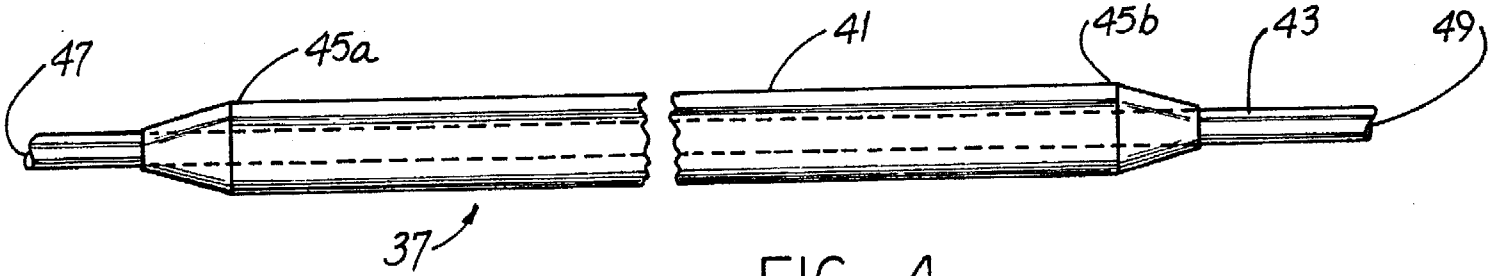
FIG. 4 PRIOR ART
FIG. 4 is a side elevation view of a prior art remote control cable of the push-pull type. Parts are broken away.

Before describing the new remote control apparatus 10, it will be helpful to have an understanding of some aspects of a remote control cable 37 of the push-pull type. As shown in FIG. 4, a typical remote control cable 37 has a generally cylindrical outer conduit 41 and a "rod-like" core 43 movable in the conduit 41. Both the conduit 41 and the core 43 are flexible and the core 43 is movable in the conduit 41, notwithstanding such flexibility. In use, the cable 37 may extend over a considerable distance and define a very "serpentine" path.

Typically, both ends **45*a*, 45*b* of the conduit 41 are held at fixed locations and an input force is applied to the core 43 at the core input end 47. An output force which, but for slight frictional losses, is substantially-undiminished, is available at the core output end 49**.

Figure 5:
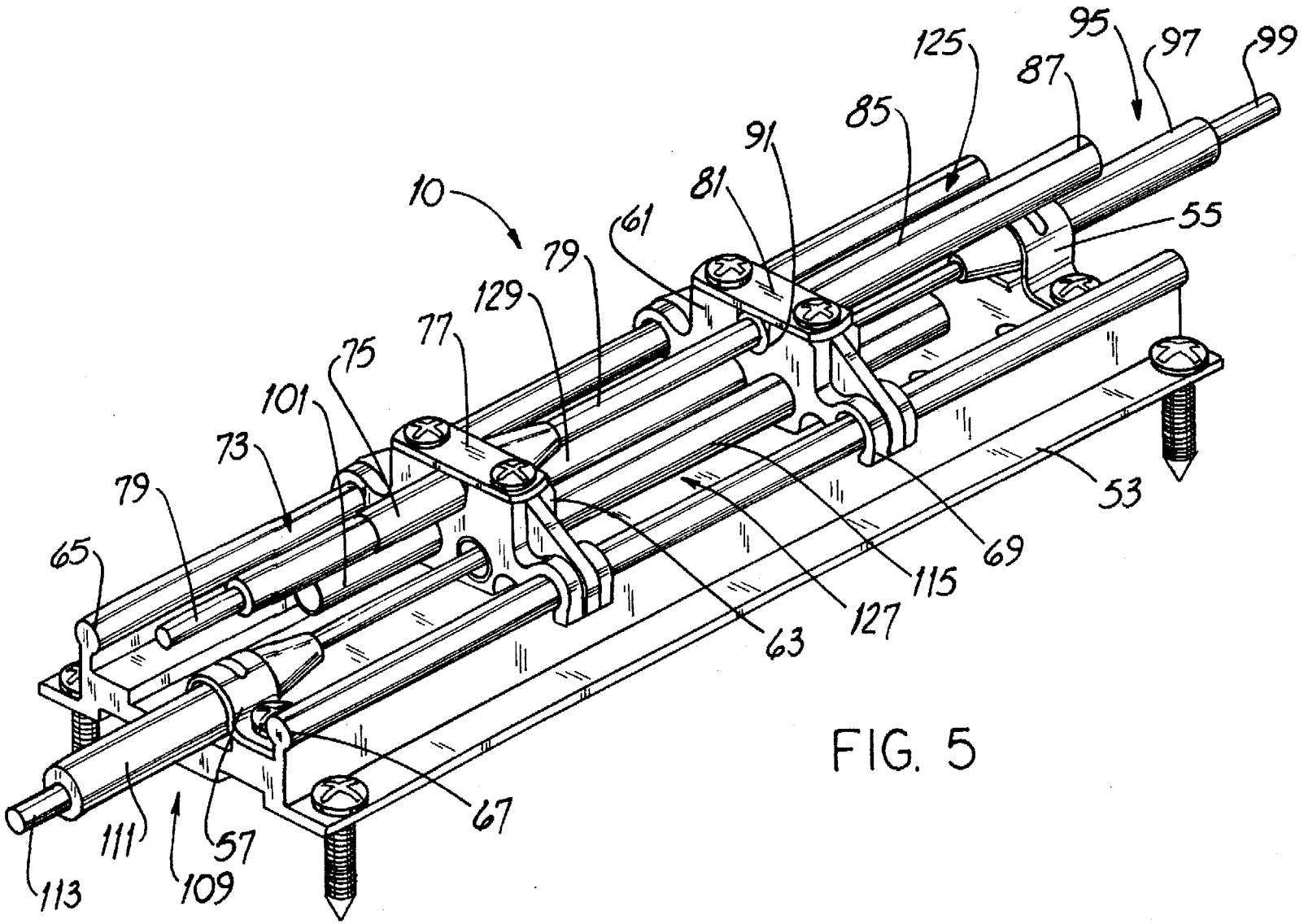
FIG. 5 is an isometric view of the new apparatus.
Figure 6:
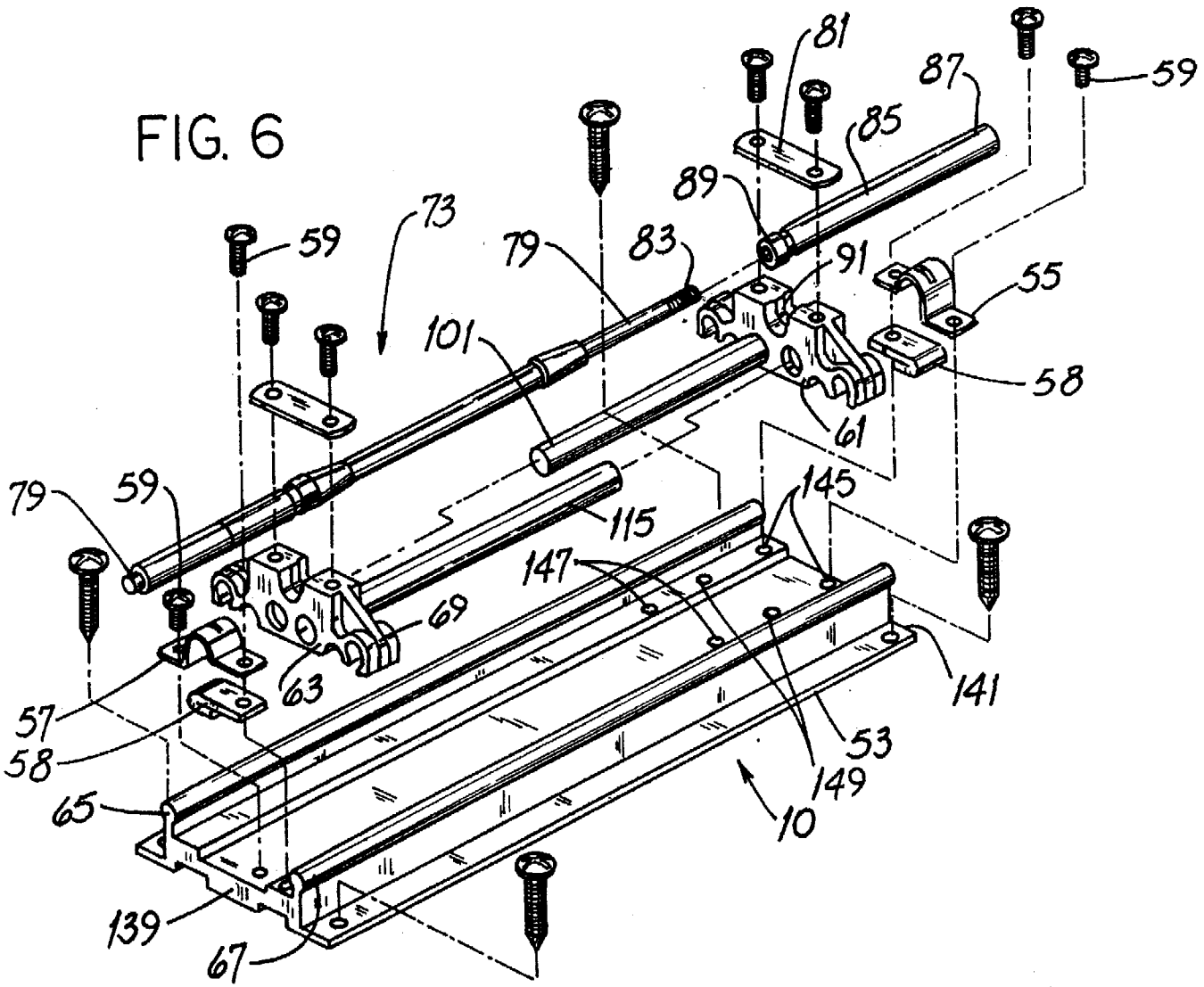
FIG. 6 is an exploded view of the new apparatus of FIG. 5. Certain parts are omitted for clarity.
Figure 7:
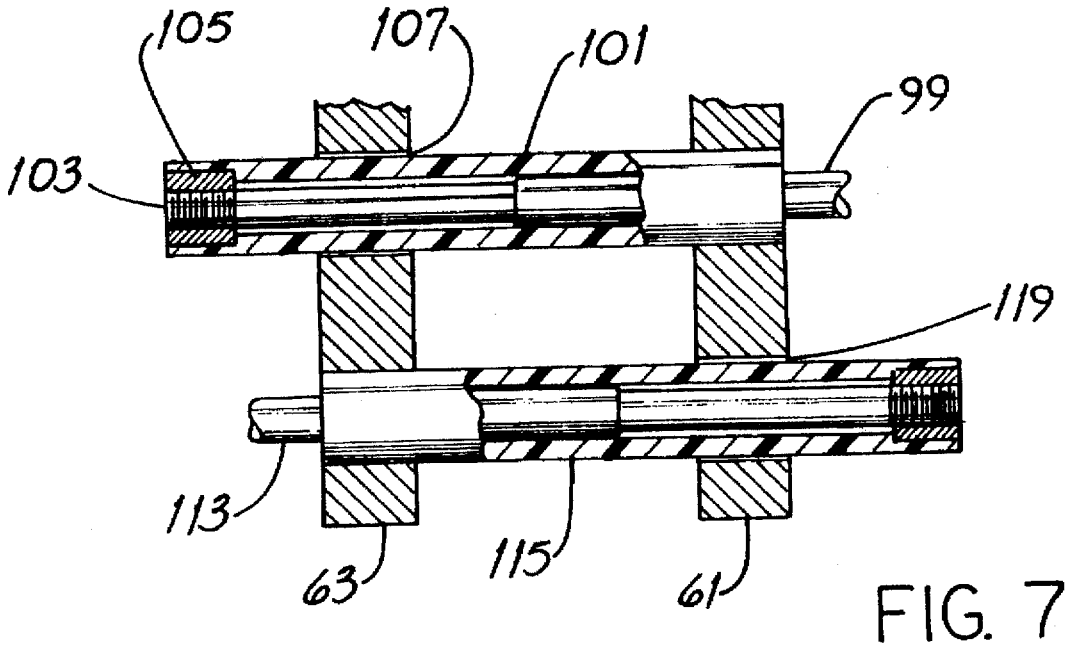
FIG. 7 is a top plan view, partly in section, of certain components of the apparatus of FIGS. 5 and 6.

Details of the new remote-control apparatus 10 will now be set forth. Referring next to FIGS. 5, 6 and 7, the new apparatus 10 has a base 53 and first and second end plates 55 and 57, respectively, which are fixed with respect to such base 53. Attachment of the plates 55, 57 to the base 53 is with spacers 58 and by screws 59 or other suitable fasteners.

Mounted between the end plates 55, 57 are first and second sliders 61 and 63, respectively, which are supported with respect to the base 53. In a highly preferred embodiment, such sliders 61, 63 are mounted on and movable along rails 65 and 67. Mounting is by hook-like arms 69 engaging respective rails 65 or 67.

The apparatus 10 also includes a first cable 73 having a first conduit 75 coupled to the second slider 63 by, e.g., a clamp 77. The first core 79 of the cable 73 is movable in and with respect to the conduit 75 and is coupled to the first slider 61 by a clamp 81. Slider/core coupling involves telescoping the threaded end 83 of the first core 79 into a first tube 85 and threading such end 83 to the internal threads at the distal end 87 of such first tube 85. The proximal end 89 of the tube 85 is coupled to the first slider 61 at the location 91.

The output cable 95 has a conduit 97 supported with respect to the base 53 in that such conduit 97 is clamped with respect to the base 53 by the first end plate 55. The output core 99 of the cable 95 is movable in and with respect to the clamped conduit 97 and is coupled to the first slider 61 by an output tube 101. Referring particularly to FIG. 7, coupling of the first slider 61 and the output tube 101 is by telescoping the threaded end 103 of the output core 99 into the output tube 101 and threading such end 103 to the distal end 105 of such output tube 101. In a highly preferred embodiment, the output tube 101 and the first slider 61 are integrally molded. However, the tube 101 may be attached to such slider 61 by threads. But however attached, the output tube 101 extends through an opening 107 in the second slider 63 with slight clearance.

The apparatus 10 also has a second cable 109 which includes a second conduit 111 clamped with respect to the base 53 by the second end plate 57. The core 113 of the cable 109 (also referred to as a "second core 113") is coupled to the second slider 63 and is movable in and with respect to the second conduit 111. Coupling of the core 113 and second tube 115 and of the tube 115 and, preferably, the integrally-molded slider 63 are by telescoping and threading as described above. Such tube 115 extends through an opening 119 in the first slider 61 with slight clearance.

From the foregoing, it will be appreciated that using tubes 101 and 115 which extend through the sliders 63 and 61, respectively, permits independent movement of such sliders 61, 63 and their "companion" attached tubes 101, 115, respectively, with respect to one another. For example, the first slider 61 and integral output tube 101 and the second slider 63 and its integral second tube 115 are relatively movable with respect to one another since the tubes 101, 115 can move freely in and through the respective sliders 63, 61.

It is to be appreciated that the points of contact of the arms 69 with the rails 65, 67 and the tubes 101, 115 extending through sliders 63, 61, respectively, define what may be described as three points of a plane which includes a particular slider 61 or 63. The disclosed arrangement helps guide the sliders 61, 63 along the rails 65, 67 and prevent the sliders 61, 63 from "cocking" or binding.

In one embodiment, each of the first, second and output cables 73, 109, 95, respectively, has a terminus generally denoted by the numerals 125, 127 and 129, respectively. Each terminus 125, 127, 129 is adjacent to the base 53.

Referring to FIGS. 1, 2A, 5, 6 and 7, using the aforedescribed arrangement, an input force originating at a first control device 17 and extending along the first core 79 is coupled to the output core 99 through the first slider 61. An input force originating at a second control device 19 and extending along the second core 113 is coupled to the output core 99 through the second slider 63, the first core 79 and the first slider 61.

It is to be appreciated that absent an input force on a cable core, such core and its surrounding conduit move in unison due to slight friction therebetween. The apparatus 10 uses this fact to advantage. With an input force originating at the second control device 19, the second core 113 moves the second slider 63. Since the first conduit 75 is clamped to the second slider 63 and since it is assumed there is no input force on the first core 79, the first conduit 75 and its core 79 move in unison. Movement of the first conduit 75 and first core 79 causes movement of the first slider 61 (note the coupling tube 85) and consequent movement of the output core 99 coupled to such slider 61 by the output tube 101.

Figure 2B:
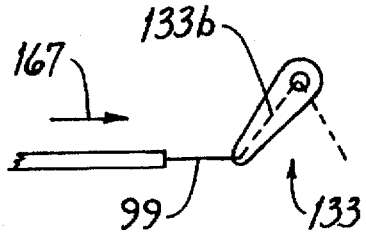
FIG. 2B is a diagram of an alternate push-to-actuate throttle.

In the preceding portion of this specification, the apparatus 10 is described as being suitable for use with mechanisms 133 (e.g., engine throttles) of either the pull-to-actuate type **133*a*, shown in FIG. 2A, or push-to-actuate type 133*b* shown in FIG. 2B. The following explains yet other features of the apparatus 10** which help provide such flexibility in use.

One of the two spaced end plates, e.g., the plate 57, is attached to one end 139 of the base 53 at a fixed location. The other end 141 of the base 53 includes a first group of holes 145 for mounting the end plate 55 to configure the apparatus 10 to operate a mechanism, e.g., a throttle, of the pull-to-actuate type **133*a*. There is also a second group 147 of holes for alternatively mounting the end plate 55, thereby configuring the apparatus 10 to operate a mechanism 133 of the push-to-actuate type 133*b***.

The end plate 55 is mounted to the base 53 using the third group of holes 149 when the apparatus 10 is used to operate a bi-directionally-actuated mechanism 153 requiring movement to either side of a center or neutral position. The aforedescribed clutch is but one example. In a specific embodiment, the third group of holes 149 is between the first group 145 and the second group 147.

(Configuring the apparatus 10 to have a single fixed end plate 57 and a single "re-positionable" end plate 55 offers some manufacturing economies and ease of assembly and use. After appreciating the foregoing, persons of ordinary skill will recognize that the same functional result can be achieved by configuring the base 53 to include sets of holes so that both end plates 55, 57 can be re-positioned. Such configuration is contemplated by the invention.)

The following sets out more detailed information as to how the new apparatus 10 may be used to control various types of mechanisms such as mechanisms 133, 153. In the arrangement in FIG. 2A, the clutch mechanism 153 is of the bi-directionally-actuated type in that clockwise/forward movement of either lever LA, LB from its neutral position N causes the clutch mechanism 153 to move to the position 155, thus engaging the engine clutch in a manner to rotate the propeller in a direction to power the boat 11 forward. Similarly, counterclockwise/reverse movement of either lever LA, LB from its neutral position N causes the clutch mechanism 153 to move to the position 157, thus engaging the engine clutch in a manner to rotate the propeller to power the boat 11 rearward or aft.

Figure 8:
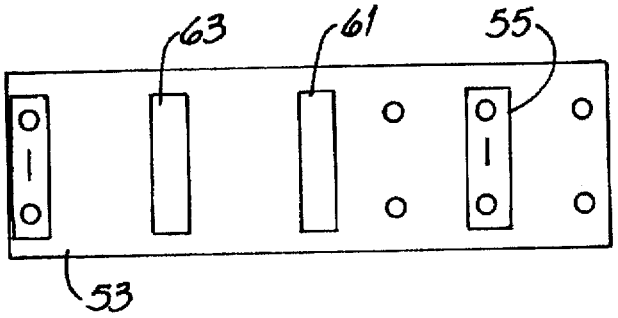
Figure 9:
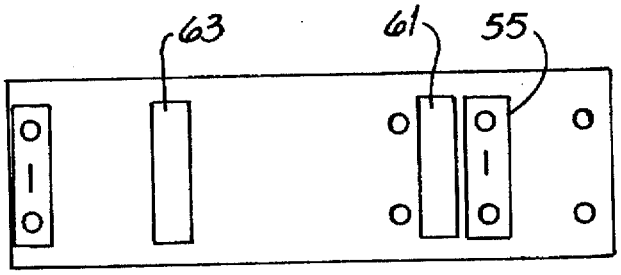
Figure 10:
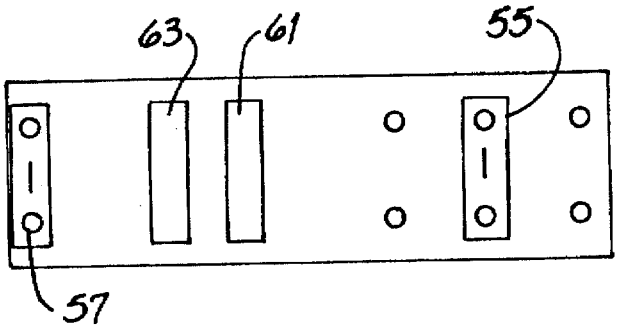

When the levers LA, LB and the apparatus 10C are in the neutral position, the apparatus 10C (and, particularly, its first and second sliders 61, 63, respectively, and its first end plate 55) appear as in FIG. 8. When the lever LA and the apparatus 10C are in the forward-drive position, the apparatus 10C and its first and second sliders 61, 63 appear as in FIG. 9, and when the lever LA and the apparatus 10C are in the reverse-drive position, the apparatus 10C and its first and second sliders 61, 63 appear as in FIG. 10.

Figure 11:
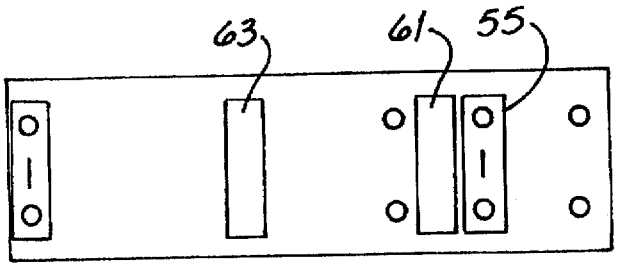
Figure 12:
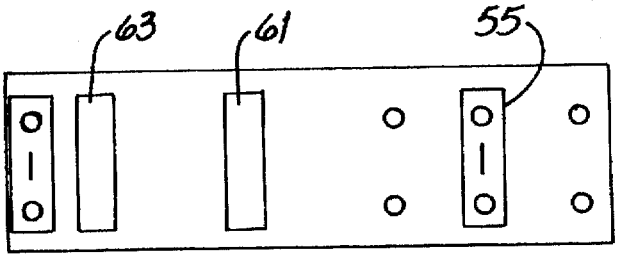

Similarly, when the lever LB and the apparatus 10C are in the forward-drive position, the apparatus 10C appears as in FIG. 11. And when the lever LB and the apparatus 10C are in the reverse-drive position, the apparatus 10C appears as in FIG. 12.

Figure 13:
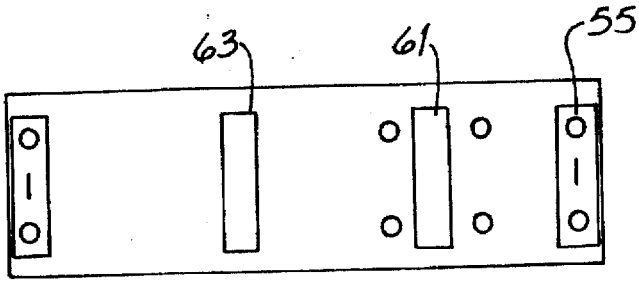

The throttle mechanism 133 shown in FIG. 2A is of the pull-to-actuate type **133*a* in that at the lowest engine speed setting, the mechanism 133 is at the repose position 161, being urged there by (usually) a biasing spring. And at the lowest engine speed setting, the apparatus 10T and its first and second sliders 61, 63 and end plate 55 appear as shown in FIG. 13**.

(When considering the following, it will be helpful to have an understanding of a particular aspect of the devices 17, 19. The throttle-control components of such devices 17, 19 are "direction insensitive." That is, such devices are configured so that the core 79 or 113 of a remote control cable 73, 109 connected thereto is urged in the same direction, irrespective of whether the lever LA or LB is moved forward from center or rearward from center. However, the clutch-controlling component of movement, immediately to either side of the neutral N position, is direction-sensitive in that the clutch is engaged forward or reverse, depending upon whether the lever LA, LB is moved clockwise or counterclockwise, respectively.)

Figure 14:
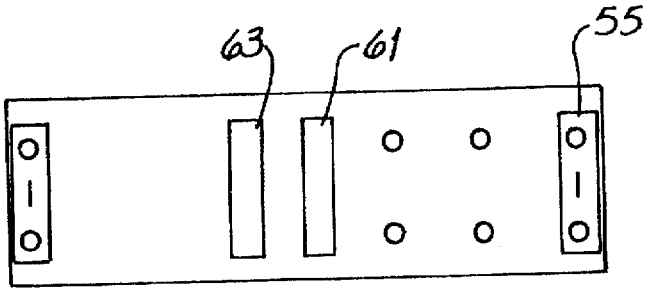

As the lever LA is moved further clockwise or counterclockwise away from a clutch-engaging position and through a throttle-actuating position, the first slider 61 of the apparatus 10T moves toward and, finally, to the position shown in FIG. 14. As a consequence, the output conduit 99 of the output cable 95 applies a force to the mechanism **133*a* in the direction of the arrow 165, i.e., in a direction toward the remote-control apparatus 10T used to control such mechanism 133*a***.

Figure 15:
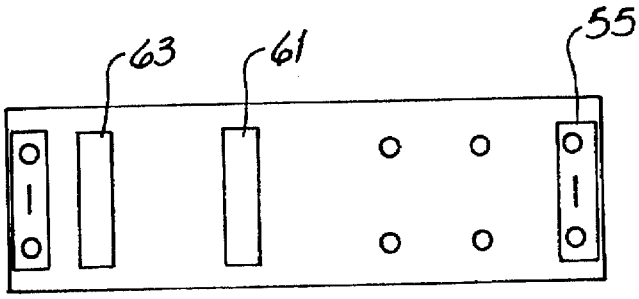
Figure 16:
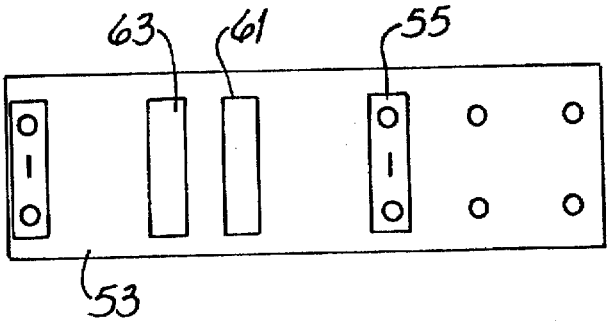

Similarly, as the lever LB is moved further clockwise or counter-clockwise away from a clutch-engaging position and through a throttle-actuating position, the first and second sliders 61, 63 of the apparatus 10T moves toward and, finally, to the positions shown in FIG. 15. The core 99 of the output cable 95 applies a force to the mechanism **133*a* in the direction of the arrow 165**.

Referring to FIG. 2B, in the alternative, the throttle mechanism 133 may be of the push-to-actuate type **133*b*. When the throttle mechanism is at the repose position shown in solid outline, the apparatus 10T** appears as shown in FIG.

Figure 17:
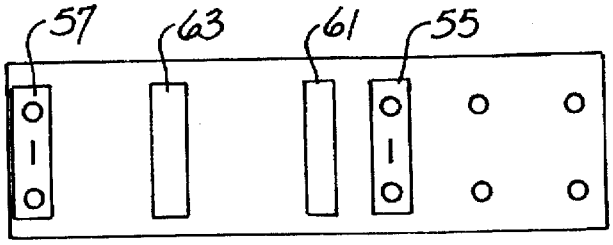

16. As the lever LA is moved further clockwise or counterclockwise away from a clutch-engaging position and through a throttle-actuating position, the first slider 61 of the apparatus 10T moves toward and, finally, to the position shown in FIG. 17. As a consequence, the core 99 of the output cable 95 applies a force to the mechanism **133*b* in the direction of the arrow 167, i.e., in a direction away from the remote-control apparatus 10T used to control such mechanism 133*b***.

Figure 18:
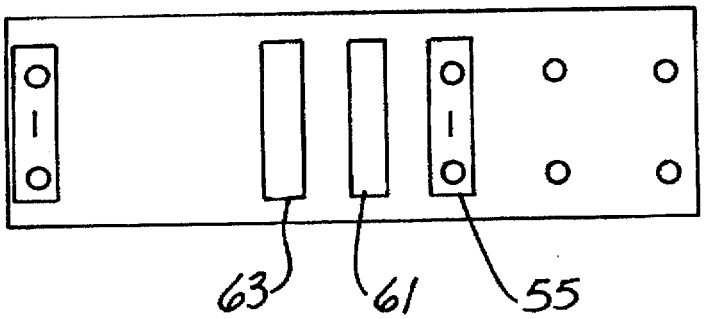
FIGS. 8 through 18 contemplate controlling a clutch and a throttle from either of two levers "LA" or "LB.

Similarly, as the lever LB is moved further clockwise or counterclockwise away from a clutch-engaging position and through a throttle-actuating position, the first and second sliders 61, 63 of the apparatus 10T move toward and, finally, to the positions shown in FIG. 18. The core 99 of the output cable 95 applies a force to the mechanism **133*b* in the direction of the arrow 167**.

From the foregoing, it will be appreciated that the sliders 61, 63 and of the apparatus 10C and 10T are at different positions with respect to the base 53, depending upon whether the lever LA or the lever LB is being manipulated. And in the case of apparatus 10T used for throttle control, the positions of such sliders 61, 63 depend upon whether the throttle is of the push-to-actuate or of the pull-to-actuate type.

Figure 19:
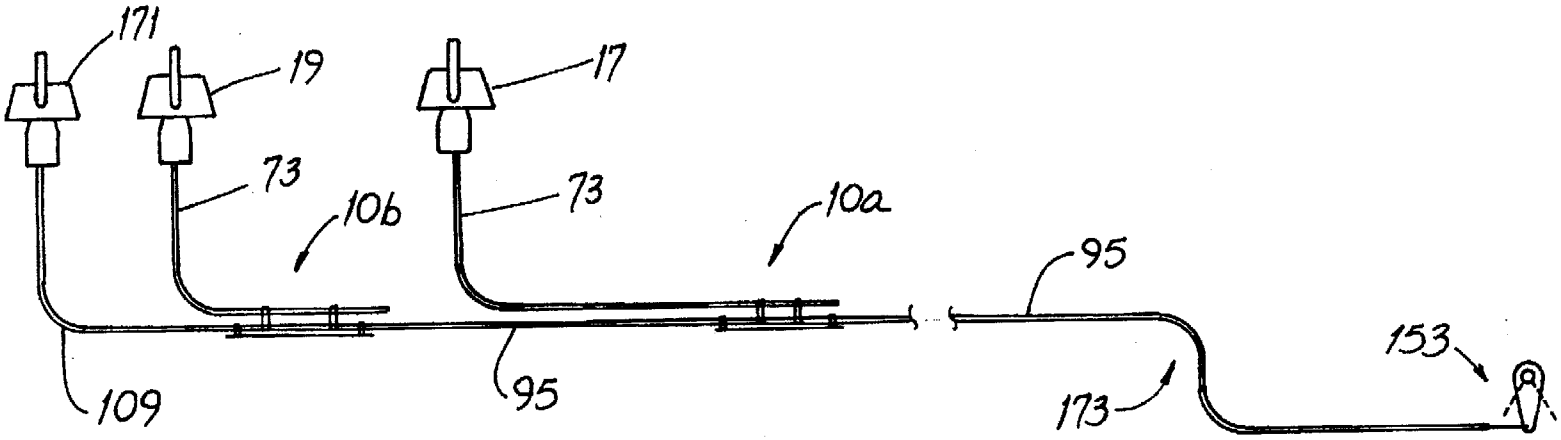
FIG. 19 is a schematic diagram showing how two apparatus may be cascaded, i.e., connected in series, for controlling a mechanism using any of three different control devices.

FIG. 19 shows how two apparatus **10*a*, 10*b* may be readily cascaded, i.e., connected in series. The output cable 95 of apparatus 10*a* is coupled to the mechanism 153 being controlled and the first cable 73 of apparatus 10*a* is coupled to a first control device 17. The output cable 95 of apparatus 10*b* is coupled to apparatus 10*a* at that location to which the second cable 109 is coupled to the apparatus 10 of FIG. 5. The first and second input cables 73 and 109, respectively, of apparatus 10*b* are similarly coupled to second and third control devices 19 and 171, respectively. In that way, all three control devices 17, 19, 171 are capable of controlling the mechanism 159. And it is to be noted that the apparatus 10*a* and 10*b* may be mounted closely proximate one another and to the control devices 17, 19, 171**.

Even using three control devices 17, 19, 171, one need only run a single length 173 of output cable 95 to such mechanism 153. And when one appreciates that the apparatus **10*a*, 10*b* and the mechanism 153 being controlled thereby may be a considerable distance from one another, e.g., 15–20 feet, it becomes apparent how the new apparatus 10** reduces the number and length of cable used in the overall installation.

Figure 20:
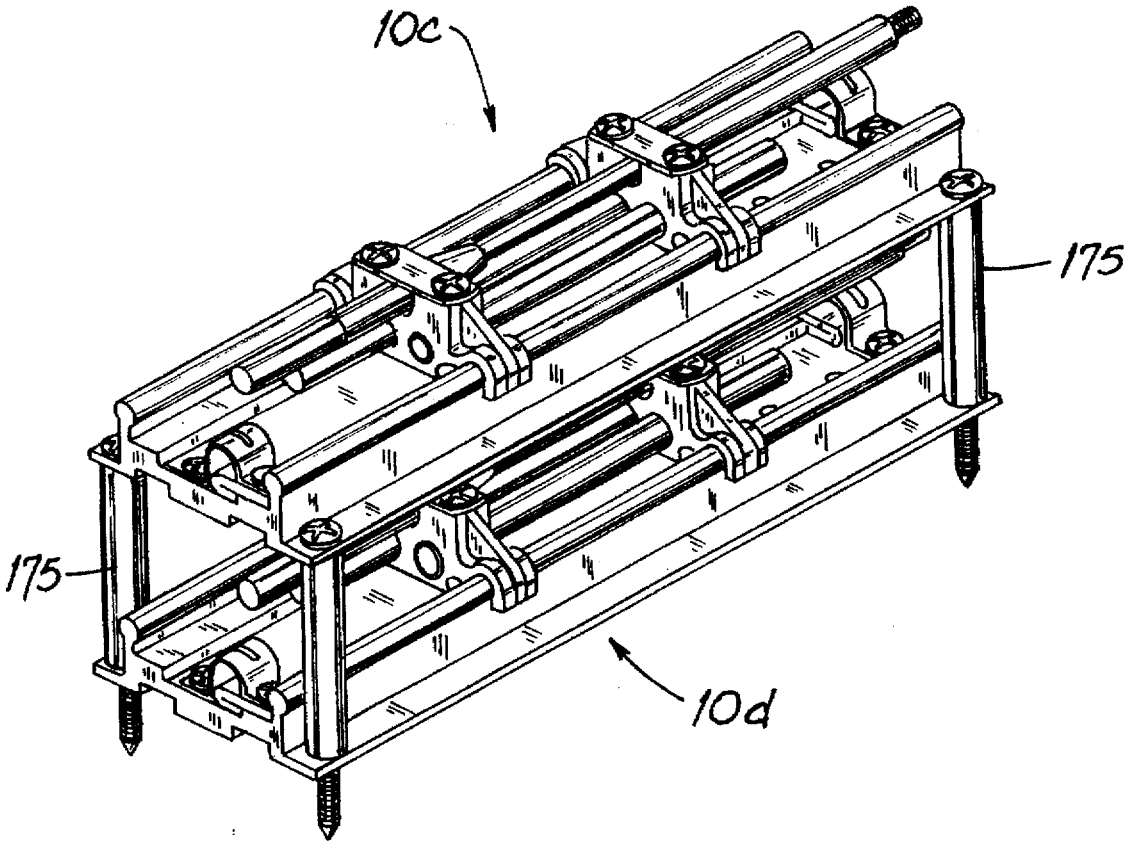
FIG. 20 is an isometric view showing how two apparatus may be stacked for operation.
Figure 23:
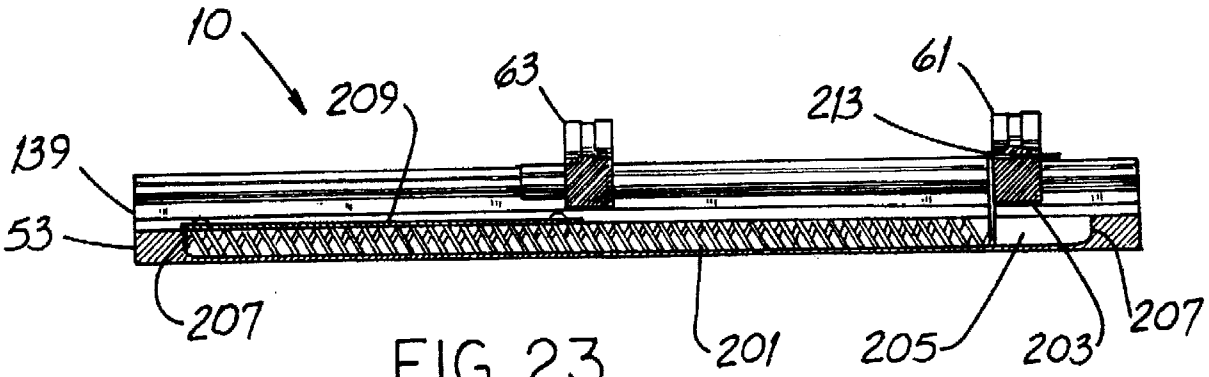
FIG. 23 is a side elevation section view of the apparatus of FIGS. 21 and 22 taken along the viewing plane 23–23 thereof.
Figure 21:
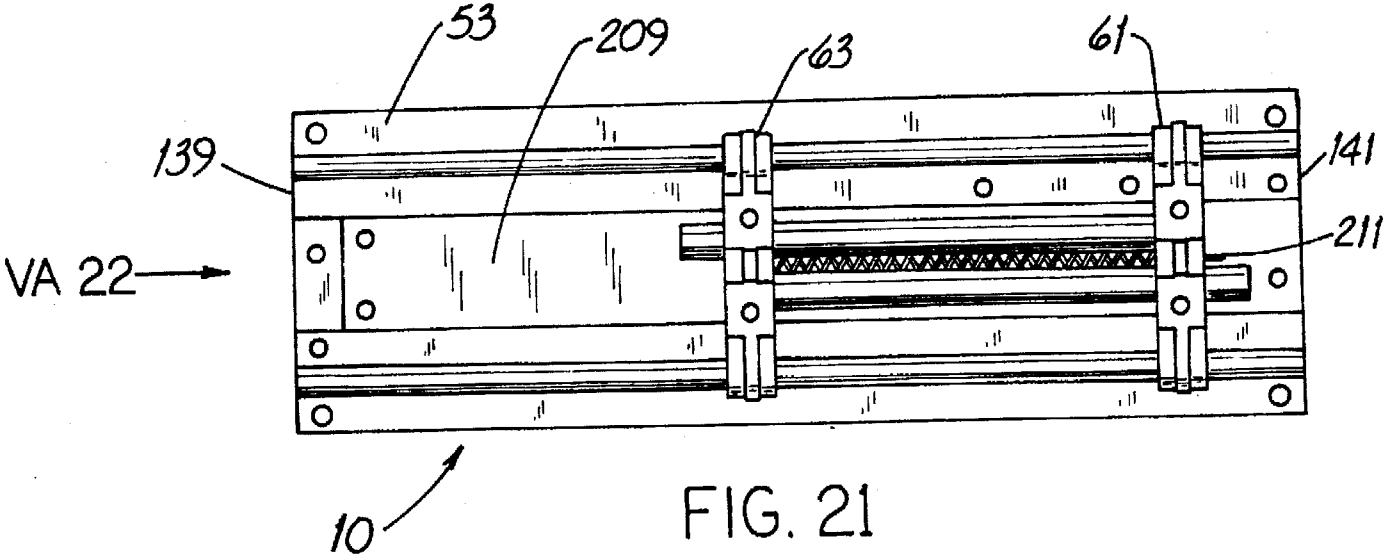
FIG. 21 is a top plan view of another embodiment of the new apparatus which includes a return spring. Parts are omitted for clarity.
Figure 22:
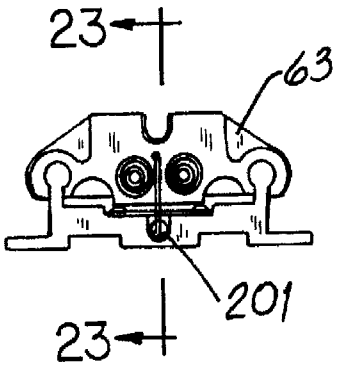
FIG. 22 is an end view of the apparatus of FIGURE 21 taken along the viewing axis VA 22 thereof.

Referring next to FIG. 20, in another configuration, plural apparatus 10 may be used by mounting first and second apparatus **10*c*, 10*d*, respectively, in stacked relationship to one another. Plural, post-like spacers 175 extend between the first and second apparatus 10*c*, 10*d* to retain such apparatus 10*c*, 10*d* in a fixed, spaced relationship with respect to one another. While two apparatus 10*c*, 10*d* are shown, three or more apparatus 10** may be stacked.

Referring next to FIGS. 2A, 2B, 21, 22 and 23, another embodiment of the new apparatus 10 includes a return spring 201 coupled to the first slider 61 and urging such slider 61 to a repose position 203. More specifically, the base 53 has a longitudinal slot 205 formed along substantially the entirety of the length of the base 53. Most preferably, both ends 207 of the slot 205 are "blind" in that they terminate inward of the respective ends 139, 141 of the base 53. In that way, the ends 207 form an abutment against which an end of the spring 201 may bear.

A retention cover 209 is over one end of the spring 201 and the other end of such spring 201 includes a hook portion 211 extending through a portion-retaining hole 213 in the slider 61. The spring 201 may be the primary spring urging the first slider 61 to the repose position 203. Or if the mechanism 133 being controlled by the apparatus 10 includes a primary return spring, the spring 201 is redundant thereto. (Persons of ordinary skill in the art will recognize that one may use two or more springs 201 for the described purpose.)

Another aspect of the invention involves a method for remotely controlling a mechanism such as a throttle 133 or clutch 153. The method includes the steps of providing a system having first and second sliders 61, 63 and an output cable 95 with its output core 99 extending between the first slider 61 and the mechanism 133 or 153. The provided system also has a first input cable 73 with its core 79 extending between a first control device 17 and the first slider 61, and has a second input cable 109 with its core 113 extending between a second control device 19 and the second slider 63. Such control devices 17, 19 are typically human-operated, manual-input devices.

The first device 17, e.g., a helm throttle lever, is manipulated to apply a force to the controlled mechanism 133 through the first core 79, the first slider 61 and the output core 99. A more specific method also includes manipulating the second device 19 to apply a force to the mechanism 133 through the second core 113, the second slider 63, the first core 79 and the first slider 61.

As used herein, the phrase "push-to-actuate" (as applied to a mechanism being controlled) means a mechanism of the type requiring a force applied to the mechanism in a direction away from the remote-control apparatus 10 used to control such mechanism. The phrase "pull-to-actuate" means a mechanism of the type requiring a force applied to the mechanism in a direction toward the remote-control apparatus 10 used to control such mechanism. The phrase "bi-directionally-actuated" means a mechanism of the type requiring a force applied to the mechanism in directions both toward and away from the remote-control apparatus 10 used to control such mechanism.

While the principles of the invention have been shown and described in connection with specific embodiments, it is to be understood clearly that such embodiments are by way of example and are not limiting.

What is claimed:

1. In a remote-control apparatus having (a) a base, (b) a slider supported with respect to the base, (c) a first cable including a first conduit and a first core coupled to the slider and movable in the first conduit, and (c) an output cable including a clamped conduit supported with respect to the base and having an output core movable in the clamped conduit, the improvement wherein the slider is a first slider and the apparatus includes:

a second slider supported with respect to the base;

a second cable having (a) a second conduit and (b) a second core coupled to the second slider and movable in the second conduit;

and wherein:

the first core and the output core are coupled to the first slider; and the second core is coupled to the second slider.

2. The apparatus of claim 1 wherein the clamped conduit of the output cable is fixed with respect to the base.

3. The apparatus of claim 2 wherein the second conduit is fixed with respect to the base.

4. The apparatus of claim 1 wherein the output core is coupled to the first slider by an output tube attached to the first slider and extending through the second slider.

5. The apparatus of claim 4 wherein the second core is coupled to the second slider by a second tube attached to the second slider and extending through the first slider.

6. The apparatus of claim 1 wherein a force along the first core is coupled to the output core through the first slider.

7. The apparatus of claim 6 wherein a force along the second core is coupled to the output core through the second slider.

8. The apparatus of claim 6 wherein a force along the second core is coupled to the output core through the second slider and the first core.

9. The apparatus of claim 1 including an end plate and wherein the base includes:

a first group of holes for mounting the end plate, thereby configuring the apparatus to operate a mechanism of the pull-to-actuate type; and a second group of holes for mounting the end plate, thereby configuring the apparatus to operate a mechanism of the push-to-actuate type.

10. The apparatus of claim 9 wherein the base includes a third group of holes for mounting the end plate, thereby configuring the apparatus to operate a bi-directionally-actuated mechanism.

11. The apparatus of claim 10 wherein the third group of holes is between the first group and the second group.

12. The apparatus of claim 1 wherein:

each of the cables has a terminus; and each terminus is adjacent to the base.

13. The apparatus of claim 1 in combination with a second apparatus, and wherein:

the apparatus of claim 1 is a first apparatus;

the first and second apparatus are mounted in stacked relationship to one another; and at least one spacer extends between the first and second apparatus.

14. The apparatus of claim 1 including a spring coupled to the first slider and urging such first slider to a repose position.

15. A method for remotely controlling a mechanism including the steps of:

providing a system having (a) first and second sliders, (b) an output cable having an output core extending between the first slider and the mechanism, (c) a first input cable having a first core extending between a first control device and the first slider, and (d) a second input cable having a second core extending between a second control device and the second slider;

manipulating the first device to apply a force to the mechanism through the first core, the first slider and the output core.

16. The method of claim 15 including:

manipulating the second device to apply a force to the mechanism through the second core, the second slider, the first core and the first slider.

* * * * *